United States Patent [19]

Caldwell

[11] Patent Number: 5,030,104

[45] Date of Patent: Jul. 9, 1991

[54] TIME TELLING LEARNING DEVICE

[76] Inventor: Dale R. Caldwell, 7925 Kildare Ave., Skokie, Ill. 60076

[21] Appl. No.: 537,120

[22] Filed: Jun. 13, 1990

[51] Int. Cl.[5] ..... G04B 19/06; G04B 19/08; G09F 19/12

[52] U.S. Cl. ..... 434/304; 368/228; 368/232; D10/126

[58] Field of Search ..... 434/304; 368/223, 228, 368/232; 235/119, 120, 116; D10/22, 23, 126

[56] References Cited

U.S. PATENT DOCUMENTS

| | | | |
|---|---|---|---|
| D. 151,204 | 10/1948 | Adamson | D10/126 |
| D. 232,219 | 7/1974 | Strong et al. | D10/126 |
| D. 232,706 | 9/1974 | Strong et al. | D10/126 |
| D. 260,743 | 9/1981 | Haller | D10/126 |
| D. 271,288 | 11/1983 | Bernick | D10/126 |
| D. 297,512 | 9/1988 | Kowalenko et al. | 434/304 |
| 1,370,401 | 3/1921 | Becker | 368/232 |
| 2,443,468 | 6/1948 | Madden | 434/304 |
| 2,594,877 | 4/1952 | Crockett | 368/223 |
| 4,124,945 | 11/1978 | Totten | 434/304 |
| 4,885,731 | 12/1989 | Massaro | 434/304 |

FOREIGN PATENT DOCUMENTS

| | | | |
|---|---|---|---|
| 0215391 | 3/1987 | European Pat. Off. | 368/228 |
| 438158 | 5/1912 | France | 368/232 |

OTHER PUBLICATIONS

R. A. Strong, *Star Tracker An Aid for Use in Learning About Time and Space,* Allentown Press, Md., 1969, pp. 1–7.

*Primary Examiner*—Richard J. Apley
*Assistant Examiner*—Karen G. Horowitz
*Attorney, Agent, or Firm*—Barbara R. Greenberg

[57] ABSTRACT

A device for teaching reading and passage of time which comprises a clock face composed of not less than three planes having two separate numerical scales circumferentially and concentrically disposed therein; the outer minute scale on the highest plane represented by 60 sector shapes, each sharing a common border line set at increments of 6 degrees beginning at zero degrees at the top center of the circular scale; each minute sector shape containing a plurality of minute numerals centrally spaced within each minute sector shape and directly in line with each border line interval; the inner hour scale on the next lower plane represented by 12 sector shapes each sharing a common border line set at increments of 30 degrees beginning at zero degrees at the top center of the circular scale; each hour sector containing numerals 1 to 12 centrally spaced within each hour sector and directly in line with each border line interval; each minute and hour sector shape graphically skewed; and respective hour and minute hands mounted centrally and pivotally on the lowest plane, the hour hand raised to a level of the next lower plane and being of a length as to be within the outer periphery of the lowest plane and the minute hand raised to a level of the highest plane, and being of a length as to be within the outer periphery of the next lower plane.

14 Claims, 3 Drawing Sheets

TIME TELLING LEARNING DEVICE

BACKGROUND OF THE INVENTION

This invention relates to a novel clock face construction and method useful for the reading and teaching of time.

Anyone attempting to teach someone how to tell time using a traditional analog clock face usually finds it to be a complicated, time consuming task. One complication occurs when either one or both hands of the clock are not pointing directly to a numeral or numeral index mark (hereinafter called a border line). Another complication is due to the tradition of having the hour and minute scales combined; separating them makes the time easier to describe. Other devices designed to convey the passage of time require such abstract concepts as "quarter to", "quarter after", and "half past" to indicate passage of time before and after the hour. These terms add to learner confusion.

The prior art is replete with time telling teaching devices. U.S. Pat. No. 3,131,489 shows a time teaching device where hour indicating numbers are displaced from their hour scale positions to new positions on a minute scale. Other time teaching devices utilize color as a means fo relating the hour hand to the minute hand. This is shown in U.S. Pat. No. 4,124,945. There, the clock face is divided into twelve 30 degree arc segments that correspond to hour numerals by color. U.S. Pat. No. 3,608,214 utilizes color or texture to identify sectored indicators varied in size indicating passage of time before and after the hour.

None of the aforesaid devices have the advantage of the present invention which places the clock face hour numerals and minute numerals within sector shapes having common border lines so that the hour hand and minute hand clearly indicate the correct hour and minute even when these hands point to a space between two numerals or directly on a sector border line. This advantageous result is achieved by graphically skewing the sector shapes.

The skewed sector shape is a function of enclosing each hour and minute numeral at its traditional location but within a shape that will always show which hour and minute the hour hand and minute hand is pointing to at any time throughout the passage of time. Other U.S. Patents divide the clock face into equal sections but in so doing, either move the numerals from their traditional locations as found on the traditional analog clock, in order to fit the numerals into the sections, or the numerals are placed in their traditional analog clock location but are not set completely inside the boundaries of their respective sections which causes confusion.

Also, the present invention minimizes the possibility of the user misreading the position of the hour hand or the minute hand in relation to the numbered sectors. This is accomplished by making the surface underneath the rotating hour and minute hands lower than the adjacent surfaces upon which the hour and minute numeral containing sector shapes appear. As a result, the hour and minute hands are then on the same levels as are the respective printed numerals contained in the sector shaped scales. This eliminates parallax that otherwise occurs when the hour and minute hands are mounted above the printed surface to which they are supposed to point.

SUMMARY OF THE INVENTION

Accordingly, the time telling learning device, in general, contains a clock face consisting of not less than three planes. The lowest plane is the circular space over which the hour hand revolves. The next higher plane, adjacent to the lowest plane and on the same level as the hour hand, is the circular space over which the minute hand revolves. The "highest plane" is at the same level as the minute hand. The "next higher" plane contains a plurality of numerical hour sectors, comprising an hour scale, circumferentially and concentrically arranged within the "highest plane" which contains a plurality of numerical minute sectors, also circumferentially arranged and comprising a minute scale.

The inner scale is represented by hour numerals 1 through 12, where numeral 12 is centered about the top center of the circle just as the numeral 12 appears on a traditional analog clock face. Numerals 1 through 11 continue consecutively clockwise, where each numeral is allotted a sector of 30 degrees to complete a 360 degree circular scale. Thus, each numeral has its own 30 degree sector, resulting in 12 equally spaced sectors. Each sector is of a shape that can be varied as desired; circular squared, elliptical open, partially open, fully enclosed or any other functional and esthetically pleasing shape.

Each sector, regardless of its shape has border lines that are common to its adjacent sectors. These border lines are set at increments of 30 degrees beginning at zero degrees at the top center of the inner scale and proceeding equally through 360 degrees.

The sector shapes must be presented in such a way as to make clear which numeral is in which sector shape and to which span of time on the circular inner hour scale the individual sector and its hour numeral refers. The graphic result of meeting this requirement produces a skewed sector shape.

During the period of an hour, the hour hand will move through an arc of 30 degrees from one border line to the next. As a result of the skewed sector shape, when the hour hand is observed to be pointing directly to a border line, which is common to two adjacent hour numerals and sectors, the hour hand points to the numeral indicating the correct hour time of the day. When the hour hand is not pointing directly to a border line but is still pointing toward an hour numeral, the numeral pointed to in the sector it is traversing is the correct hour. Finally, when the hour hand points to a space between two hour numerals, the sector the hour hand points to contains the correct time of the day.

The minute scale is set in the same manner as the hour scale. It appears on a plane above the hour scale and is arranged concentrically and circumferentially outside the hour scale.

The minute scale consists of sixty sets of numerals, each a double digit entry beginning with "00" and ending with "59". The numeral 00 is centered about the top center of the circle. Additional numbering continues clockwise at 6 degree intervals to comprise a minute scale of 360 degrees.

As on the hour scale, each minute numeral is placed in a sector shape the same as the previous sector. Thus, there are sixty equal sectors, each spanning an arc of 6 degrees. Each sector can be circular, squared, elliptical, open, partially open, enclosed or any other esthetically pleasing shapes.

Between each minute sector is a common border line between two adjacent sectors. These ar set at increments of 6 degrees, beginning at zero degrees at the top center of the circle and continuing equally through 360 degrees.

During a period of a minute, the minute hand moves through an arc of 6 degrees, from one border line to the next. As with the hour hand, when the minute hand points directly to a border line which is common to adjacent minute numerals and sectors, the minute hand is also pointing to the numeral that shows the correct minute of the day. When the minute hand is not on a border line but points to a minute numeral, the numeral it points to in the sector it is traversing is the correct minute. Finally, when the minute hand points to the open space within the sector it is traversing, the number within that sector contains the correct minute of the day. This result is attributed to the skewing of the minute sector shapes.

The hour and minute hands are pivotally mounted central to the minute and hour scales, where the hour hand is of such a length as to lie completely within the outer periphery of the lowest plane but reaches a height equal to the second lowest plane, and where the minute hand is of such a length as to lie completely within the periphery of the second lowest plane but reaches a height equal to the highest plane. This arrangement avoids any parallax problem that could distort the viewer's line of sight and prevent an accurate reading of the time.

The hour hand is short and the minute hand is long. The hour hand may have an arrow shaped tip to distinguish it from the long, thin minute hand pointer or either hand may have any easily recognized and described shape, as long as the hour hand is distinctly different from the minute hand. The hour and minute hands may be the same or different colors and may be made of any suitable material, the same or different from the existing clock materials.

The hour scale and numerals may be the same color as the hour hand and distinctly different from the minute scale and hand. Likewise, the minute scale and numerals may be the same color as the minute hand and distinctly different from the hour scale and hand.

The principal object of the present invention is to provide a time telling teaching device that eliminates any ambiguity as to the exact hour and minute each hand is pointing out. This is accomplished by extending graphically the span of a typical hour and minute sector but in no way distorting or moving the numerals from their traditional positions on the conventional analog face. Thus, the learner can read the time directly without having to interpolate and can easily make a transition from this learning clock face to the traditional analog clock face. Anyone who can read numerals will be able to say the time using this clock face.

Another object is to avoid any parallax problem that could exist when the user extends his or her line of sight to read the hour and minute hands. This is achieved by mounting such hands on a plane level with the hour and minute scales.

A further object is to distinguish the hour hand from the minute hand so the observer can easily see and learn which hand refers to which scale.

Another object is to separate the hour scale and minute scale.

Still another object is to provide a time teaching device where the user can look at the numbers on the separate scales and then read them or say them just as they would appear in print. For example, the hour numeral 10 on the scale and the minute numeral 13 on the scale would when printed appear as 10:13 and spoken as "ten thirteen". From numerals 00 to 09, then spoken time is also equivalent to the printed time. The printed time 10:03 would be spoken ten "o" three. There is no need to contemplate "quarter to", "quarter after", or "half past".

Finally, another object of this invention is to provide the learner with a simple transition from the present invention to the traditional analog clock face since the format of each is quite similar.

BRIEF DESCRIPTION OF THE DRAWINGS

In accordance with the above objects and such other objects and features which will become apparent from the following specification, the invention will be understood from the accompanying drawings, wherein like characters designate like parts and wherein.

DESCRIPTION OF THE PREFERRED EMBODIMENTS

Figure 1:
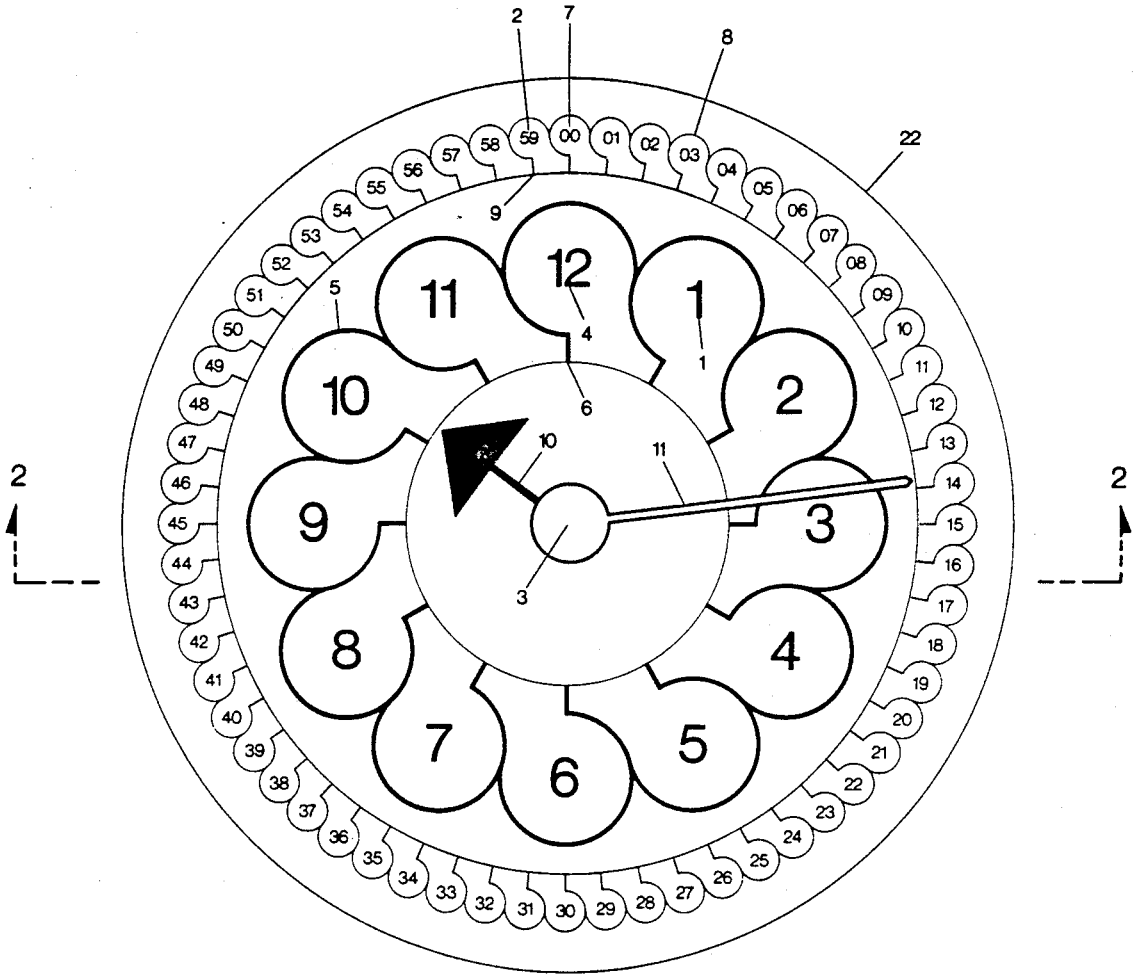
FIG. 1 is a plan view of the time learning teaching device showing circular sector shapes disposed at regularly spaced intervals on the hour and minute scales.

Referring to the drawings in detail, FIG. 1 comprises a circular learning device having two numerical scales, (1) and (2), circumferentially and concentrically disposed about a center pivot point (3). The inner scale (1) represents the hour numerals 1 to 12, arranged with the numeral 12 centered about the top center (4) of the circle, each numeral continuing clockwise at 30 degree intervals, and each numeral contained in a circular sector (5) containing a common border line (6) with an adjacent sector. The common border lines (6) are set at increments of 30 degrees beginning at zero degrees at the top center of the circle (4) and proceeding equally through 360 degrees. Beyond the common border line (6), each sector shape (5) is graphically skewed so as to encompass the hour number in its traditional analog location, yet extending clockwise to the next adjacent sector thus encompassing the full span of an hour. The hour sector shapes (5) may be circular, squared, elliptical, open, partially open, enclosed or any other desired shape with border lines (6) spaced at 30 degree intervals.

The outer scale (2) represents the minute numerals 00 to 59, arranged with the numeral 00 centered about the top center (7) of the circle, each numeral continuing clockwise at 6 degree intervals, and each numeral contained in a circular sector (8) containing a common border line (9) with an adjacent sector. The common border lines (9) are set at increments of 6 degrees beginning at zero degrees at the top center of the circle (7) and proceeding through 360 degrees. Beyond the border lines (9) each sector shape (8) is graphically skewed so as to encompass the minute number in its traditional analog location, yet extending clockwise to the next adjacent sector, encompassing the full span of a minute. The minute sector shapes (8) may be circular, squared, elliptical, open, partially open, enclosed or any other desired shape with border lines (9) of each sector spaced at 6 degree intervals.

Because there are sixty sets of minute numerals each within its own minute sector shape (8), and twelve sets of hour numerals each within its own hour sector shape (5), the hour numerals are larger than the minute numerals. This distinction in size between the hour numerals and minute numerals simplifies the learning process. However, this same end result can be achieved with other numeral shapes and sizes.

FIG. 1 shows not less than three planes containing the concentrically and circumferentially arranged hour scale components (1,5 and 6) and minute scale components (2,8 and 9) and the center pivotal mounting (3) of the hour hand (10) and minute hand (11) preferably each independently rotatable but possibly rotating as a unit in any preset position.

Also, in the preferred embodiment, the outside shape of the complete clock face is circular (22). However, the outside shape of the complete clock face may be square, rectangular, elliptical or any other appropriate design.

Figure 2:
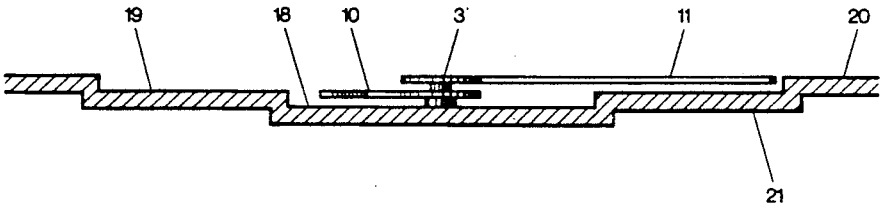
FIG. 2 is a section of FIG. 1.

Referring now to FIG. 2 of the drawings, a section of FIG. 1 is represented showing said three planes where the hour hand (10) is mounted centrally on the lowest plane (18) and raised to a level of the next lowest plane (19), being of a length as to be within the outer periphery of the lowest plane (18). The minute hand (11) is also mounted centrally on the lowest plane (18) but is raised to a level of the highest plane (20) and is of such a length as to reach the outer periphery of the next lowest plane (19). The minute hand (11) and the hour hand (10) are set at the indicated levels in order to avoid any parallax problem that may be encountered when the reader observes the portion of the minute and hour scales the hands are pointing out. The hour hand (10) is different from the minute hand (11) in length and in the preferred embodiment, has an arrow shaped tip to distinguish it from the longer, thin minute hand pointer. The hour hand (10) and the minute hand (11) may be made out of any suitable material similar to or different from each other and the clock face base (21) material. The clock face base (21) is of no appreciable thickness and can be made of any suitable material. Also, in the preferred embodiment, the shape of the lowest plane (18) and the next lower plane (19) of the clock face is circular.

Figure 3:
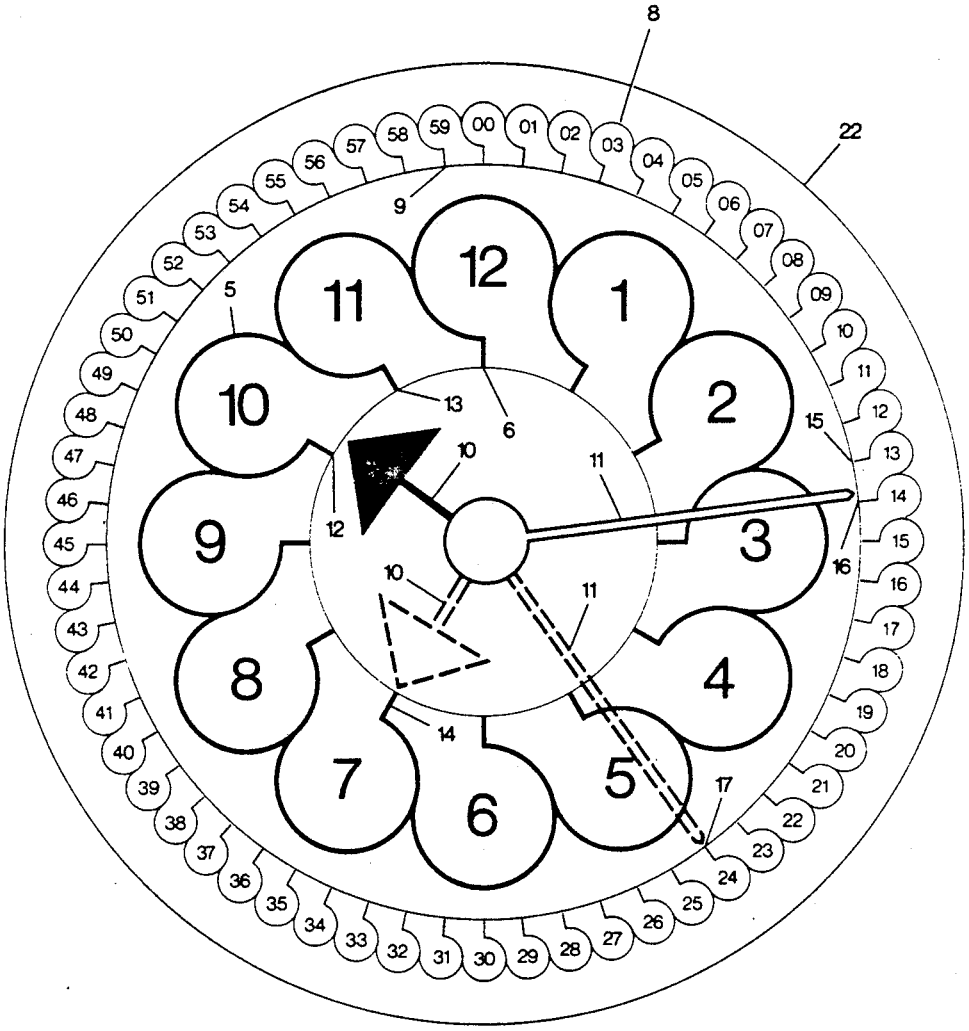
FIG. 3 is a detailed view showing the clock hands in representative positions relative to the hour and minute scales.

FIG. 3 of the drawings clearly shows the hour scale border lines (6) and minute scale border lines (9). The hour hand (10) points to a space (12 to 13) within the hour sector (5) containing the numeral 10, clearly indicating the hour as ten o'clock. The minute hand (11) pointing to a sector (15 to 16) also points to the area of the minute numeral 13, thus reading a time of 10:13. Any ambiquity that exists in other time telling devices when a hand points directly to a line between two numerals or a space between two numerals is eliminated in the present time learning device. Here, the user may read the time directly from the learning device whether the hand points to a space between numerals, directly to a numeral or to a border line between adjacent sectors.

In FIG. 3, the shape of the hour sectors (5) and the minute sectors (8) allows the user to find which hour numeral and minute numeral the hour hand (10) and minute hand (11) is indicating, when such hour hand (10) is pointing into the immediate space between two successive border lines (12 and 13), or when pointing directly to a border line (14), and when such minute hand (11) is pointing into the immediate space between two successive border lines (15 and 16) or when pointing directly to a border line (17).

In the preferred embodiment, the minute sector shapes (8) and the hour sector shapes (5) may both be of the same design as indicated. However, the hour scale may have circular sectors (5) and the minute scale may have open sectors (24), FIG. 4, or any combination thereof considering all possible sector shapes.

Figure 4:
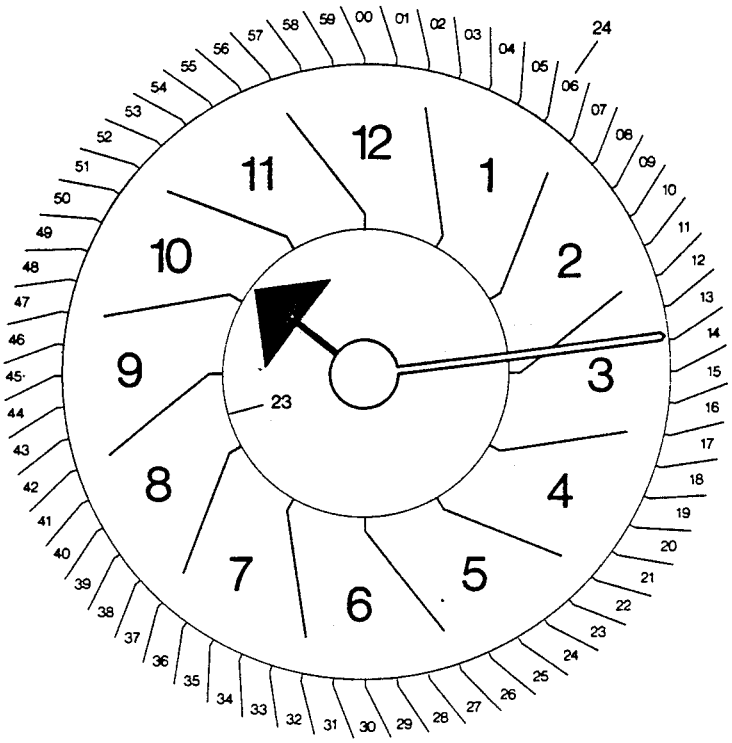
FIG. 4 is a plan view of the time learning teaching device showing open sector shapes disposed at regularly spaced intervals on the hour and minute scales.
Figure 5:
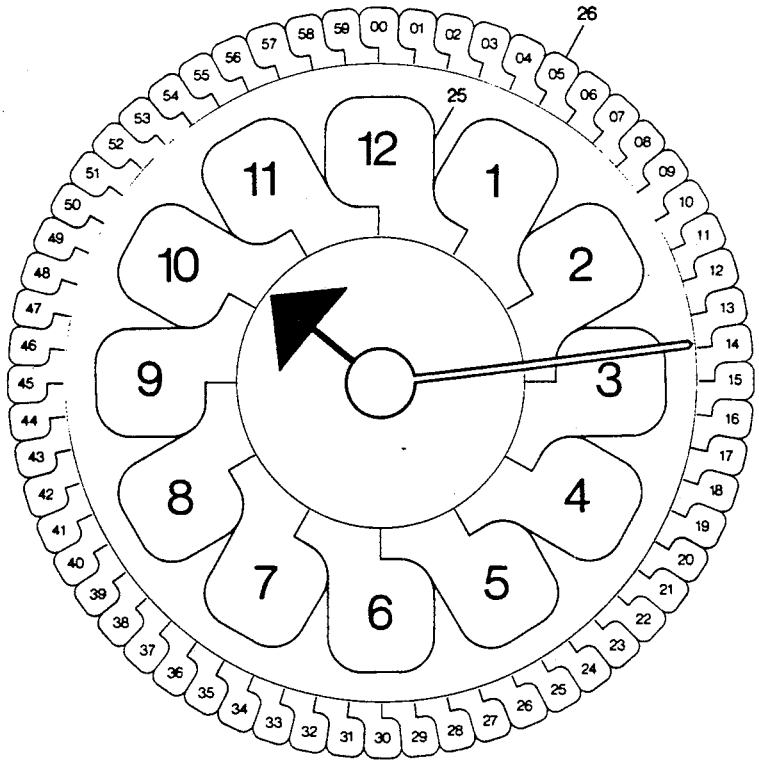
FIG. 5 is a plan view of the time learning teaching device showing square sector shapes disposed at regularly spaced intervals on the hour and minute scales.

FIG. 4 shows open shaped hour sectors (23) and open shaped minute sectors (24), and FIG. 5 shows square shaped hour sectors (25) and square shaped minute sectors (26) as two possible embodiments from a plurality of sector shapes.

Although the invention has been described with reference to specific embodiments, it will be obvious to one skilled in the art that other changes and modifications can be made that fall within the scope herein.

I claim:

1. A device for teaching reading and passage of time comprising, (a) a clock face composed of not less than three planes, (b) two separate numerical scales circumferentially and concentrically disposed therein; the outer scale occurring on the highest plane represented by minute sector shapes having borders functioning as index lines at the traditional analog location for minutes, said border lines spaced at 6 degree intervals and dividing two adjacent minute sector shapes; each minute sector shape extending from the beginning of one minute interval to the beginning of the next minute interval and being skewed to the left to encompass one of the minute numerals 00 through 59 centrally spaced within each skewed portion of said minute sector shape and directly in line with said border lines such that each minute numeral is in its traditional analog location; the inner scale occurring on the next lower plane represented by hour sector shapes having borders functioning as index lines at the traditional analog location for hours, said border lines spaced at 30 degree intervals and dividing two adjacent hour sectors; each hour sector shape extending from the beginning of one hour interval to the beginning of the next hour interval and being skewed to the left to encompass one of the hour numerals 1 through 12 centrally spaced within each skewed portion of said hour sector shape and directly in line with said border lines such that each hour numeral is in its traditional analog location; and (c) respective hour and minute hands pivotally mounted on said clock face centrally on the lowest plane, said hour hand raised to a level of said next lower plane, being of a length as to be within the outer periphery of said lowest plane, and said minute hand raised to a level of said highest plane, being of a length as to be within the outer periphery of said next lower plane;

whereby, as a result of the skewed sector shape, when either the minute or the hour hand is observed to be pointing directly to a border line, which is common to two adjacent sectors, the hand points to the numeral indicating the correct minute or hour, and when the minute or the hour hand is not pointing directly to a border line but is still pointing toward a numeral or is traversing a sector shape, the numeral pointed to or contained in the sector shape being traversed is the correct minute or hour.

2. The device of claim 1 wherein each hour and each minute sector shape is circular and graphically skewed.

3. The device of claim 1 wherein each hour and each minute sector shape is open shaped and graphically skewed.

4. The device of claim 1 wherein each hour and each minute sector shape is square shaped and graphically skewed.

5. The device of claim 1 wherein the minute and hour numerals are placed within each sector shape to be directly aligned with the border line between two adjacent sector shapes and always as an extension of the limit of the border line which functions as an index, such that the minute and hour numerals are also in the correct analog location.

6. The device of claim 1 wherein the hour hand shape is a short arrow shaped pointer having a distinct arrowhead tip and the minute hand is a long, thin pointer with a sharply pointed tip.

7. The device of claim 1 wherein the color of the hour scale and numerals will be the same color as the hour hand and distinctly different from the minute scale and hand.

8. The device of claim 1 wherein the color of the minute scale and numerals will be the same color as the minute hand and distinctly different from the hour scale and hand.

9. The device of claim 1 wherein the numbering for the minute scale is comprised completely of sixty double digit numeral sets from 00 to 59 with 00 beginning at zero degrees at the top center of the circle and with the numerals so positioned as to be aligned with the sector border lines and always positioned as an extension from the limit of the border line which functions as an index, such that the minute numerals are also in the correct analog location.

10. The device of claim 1 wherein the shape of the sectors on the minute scale can be different from the shape of the sectors on the hour scale, and the shape of the sectors on the hour scale can be different form the shape of the sectors on the minute scale.

11. The device of claim 1 wherein the sector shapes within a particular scale can be a mixture of shapes.

12. The device of claim 1 wherein smooth perpendicular exposed walls connect the highest plane with the next lower plane and connect the next lower plane with the lowest plane.

13. The device of claim 1 wherein said hour sector shapes are located so the sector shape containing numeral 12 is located at the top center of said next lower plane, the traditional analog position, and the minute sector shape containing the numeral 00 is located at the top center of said highest plane, the traditional analog position.

14. The device of claim 1 wherein the hour numerals are larger in size than the minute numerals.

* * * * *